US011035115B1

(12) United States Patent
Torres

(10) Patent No.: US 11,035,115 B1
(45) Date of Patent: Jun. 15, 2021

(54) BREAKAWAY FORM CLIP

(71) Applicant: Stockton Products, North Las Vegas, NV (US)

(72) Inventor: Angel Torres, North Las Vegas, NV (US)

(73) Assignee: Stockton Products, North Las Vegas, NV (US)

( * ) Notice: Subject to any disclaimer, the term of this patent is extended or adjusted under 35 U.S.C. 154(b) by 0 days.

(21) Appl. No.: 16/846,232

(22) Filed: Apr. 10, 2020

(51) Int. Cl.
*E04B 1/41* (2006.01)
*E04B 1/38* (2006.01)

(52) U.S. Cl.
CPC ..... *E04B 1/41* (2013.01); *E04B 2001/405* (2013.01)

(58) Field of Classification Search
CPC ..... E04B 1/41; E04B 2001/405; E04G 17/18; E04G 17/16; E04G 17/14
See application file for complete search history.

(56) References Cited

U.S. PATENT DOCUMENTS 1,719,823 A * 7/1929 Eklof ..... E04G 17/18 249/211
2,234,335 A * 3/1941 Echterling ..... E04G 17/18 249/211
2,340,439 A * 2/1944 Stroben ..... E04G 17/02 249/219.2
2,731,701 A * 1/1956 Klausner ..... E04G 17/18 249/210
3,363,373 A * 1/1968 Huss, Jr. ..... E04G 17/0754 52/98
3,599,929 A * 8/1971 Holley, Sr. ..... E04G 13/06 249/213
3,722,849 A * 3/1973 Luyben ..... E04G 13/00 249/219.1
4,054,259 A * 10/1977 Johnson ..... E04G 17/02 249/219.2
4,257,571 A * 3/1981 Franks ..... E04G 13/00 249/177
4,291,858 A * 9/1981 NeSmith ..... E04G 17/0758 249/216
4,449,335 A * 5/1984 Fahey ..... E04B 1/2608 52/713
6,237,890 B1 * 5/2001 Gates ..... E04G 11/12 249/219.1
6,477,817 B1 * 11/2002 Yurick ..... E04G 15/063 249/34
6,604,326 B1 * 8/2003 Noble ..... E04G 13/00 24/455
6,698,348 B1 * 3/2004 Bloss ..... B41N 1/24 101/127
6,928,783 B2 * 8/2005 Oliver ..... E02D 5/801 52/149
9,045,912 B2 * 6/2015 Fearn ..... E04G 17/02
2005/0217197 A1 * 10/2005 Peacock ..... E04B 1/4107 52/699

(Continued)

*Primary Examiner* — Rodney Mintz
(74) *Attorney, Agent, or Firm* — Lewis Roca Rothgerber Christie LLP

(57) ABSTRACT

A clip for holding a structural member in position relative to a member as part of a form for receiving concrete includes a main body portion, a hook portion extending from the body portion for receiving at least a portion of the structural member, and a first breakaway section between the main body portion and the hook portion. A form incorporates such clip.

21 Claims, 3 Drawing Sheets

(56) References Cited

U.S. PATENT DOCUMENTS

| | | | | |
|---|---|---|---|---|
| 2006/0260263 | A1* | 11/2006 | Cannata | E04G 17/14 52/846 |
| 2014/0166849 | A1* | 6/2014 | Fearn | E04G 17/14 249/219.2 |
| 2015/0102204 | A1* | 4/2015 | Santjer | E04G 17/064 249/219.1 |
| 2018/0002936 | A1* | 1/2018 | Murphy | B29C 39/00 |
| 2020/0199865 | A1* | 6/2020 | McEndree | E04B 1/64 |
| 2020/0354979 | A1* | 11/2020 | Rosales | E04G 17/14 |

* cited by examiner

BREAKAWAY FORM CLIP

BACKGROUND OF THE INVENTION

When forming concrete in commercial and residential structural applications, wood and/or steel is used to form forms for achieving a desired concrete shape. The forming process involves cutting and shaping the steel and wood 10 and then fastening it together with screws 12 to form and maintain the desired shape during the concrete pour, as for example shown in FIGS. 1 and 2. Moreover, structural members such as angles 14 typically made of metal are connected to the form, typically using nails or screws 12. Once the concrete has been poured and cured, the forms are removed. The structural members at least partially embedded in the concrete to provide a member for tying structural other structural members to the concrete. The removal process can be an arduous process given limited access typically available due to confined space conditions resulting in damage to the concrete when removing the nails and screws 12 and the forms and the forms from their connection with the structural members. Moreover, because the structural members are coupled to the forms with nails or screws, the typically disconnect from the forms or get offset when a worker accidentally steps on them or puts any weight on them. In an effort to overcome this steel rods 16 are often connected to the structural member 14 to provide support to the structural member 14.

SUMMARY OF THE INVENTION

In an example embodiment a clip for holding a structural member in position relative to a member as part of a form for receiving a material to be cured includes a main body portion, a hook portion extending from the body portion for receiving at least a portion of the structural member, and a breakaway section between the main body portion and the hook portion. In another example embodiment, the clip further includes an extension portion extending from the main body portion such that the hook portion extends from the extension portion. In yet another example embodiment, the breakaway section in between the extension body portion and the hook portion. In yet a further example embodiment, the breakaway section is defined by a line of perforations, serrations or lesser thickness than its adjacent portions extending along a width of the clip. In an example embodiment, the extension portion extends transversely from the main body portion. In another example embodiment, the clip further includes an arm extending transversely from the main body portion from an end of the main body portion opposite the hook portion.

In a further example embodiment, a form for receiving a material to be cured includes a form member forming a form, a structural member having a first section coupled to the form member and a second section extending transversely from the first section, a clip including a main body portion over the form member, and a hook portion extending beyond the form member, where the second section of the structural member is received in the hook portion. The clip also includes a breakaway section between the main body portion and the hook portion. In a yet further example embodiment, the main body portion is fastened to the form member. In another example embodiment, the clip also includes an extension portion extending from the main body portion and over the second section of the structural member such that the hook portion extends from the extension portion. In yet another example embodiment, the clip breakaway section is between the extension portion and the hook portion. In yet another example embodiment, the breakaway section is defined by a line of perforations, serrations or lesser thickness than its adjacent portions extending along a width of the clip. In another example embodiment, the extension portion extends transversely from the main body portion. In yet another example embodiment, the clip also includes an arm extending transversely from the main body portion from an of the main body portion opposite an end opposite the hook portion, the main body portion extends over a surface of the form member and the arm extends over another surface of the form member. In a further example embodiment, the arm is fastened to the form member. In yet a further example embodiment, a spacer is between the structural member first section the form member.

In any of the aforementioned example embodiments, the material to be cured is concrete.

DETAIL DESCRIPTION

Figure 1:
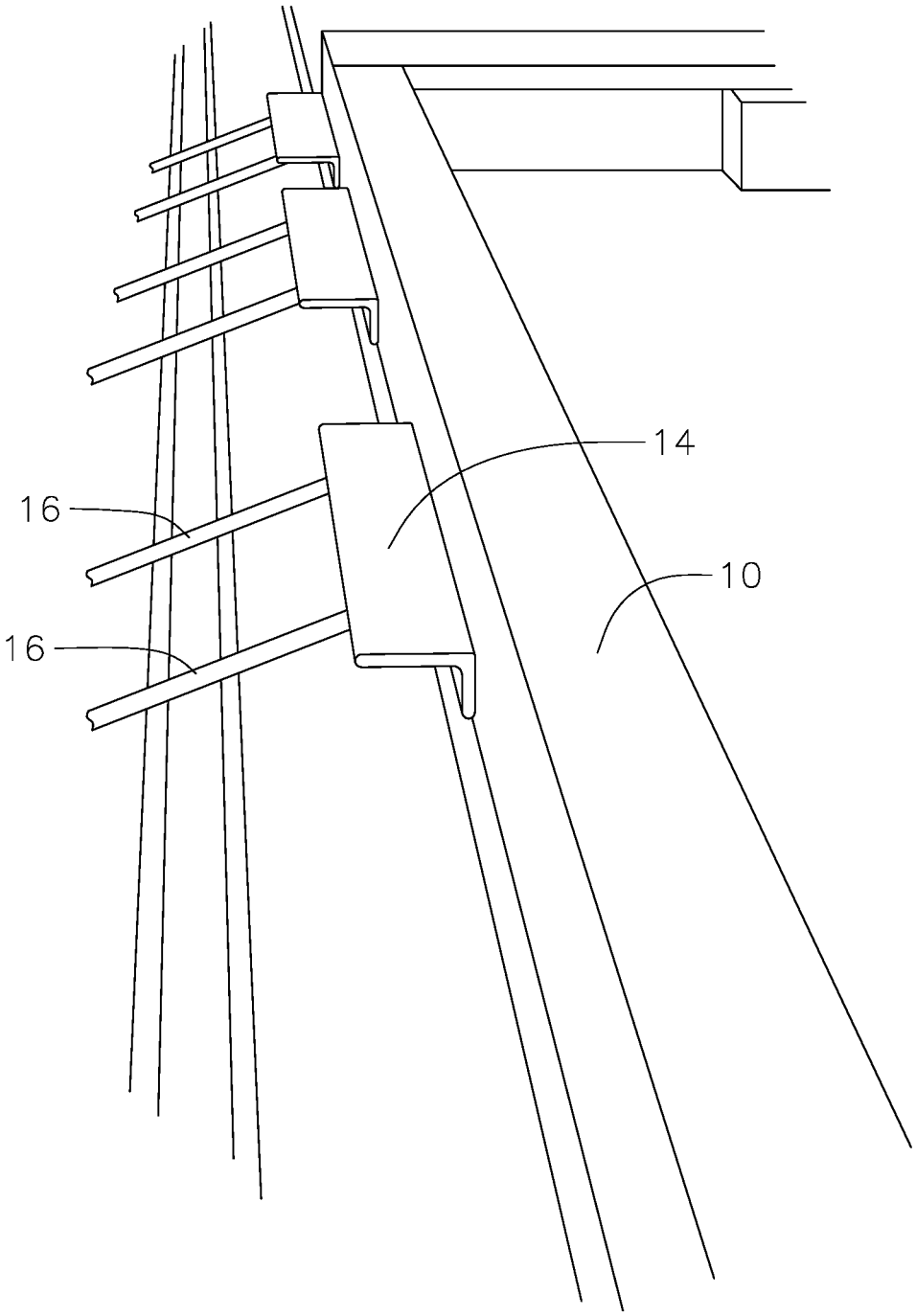
FIG. 1 PRIOR ART
FIG. 1. Is a perspective view of a prior art form.
Figure 2:
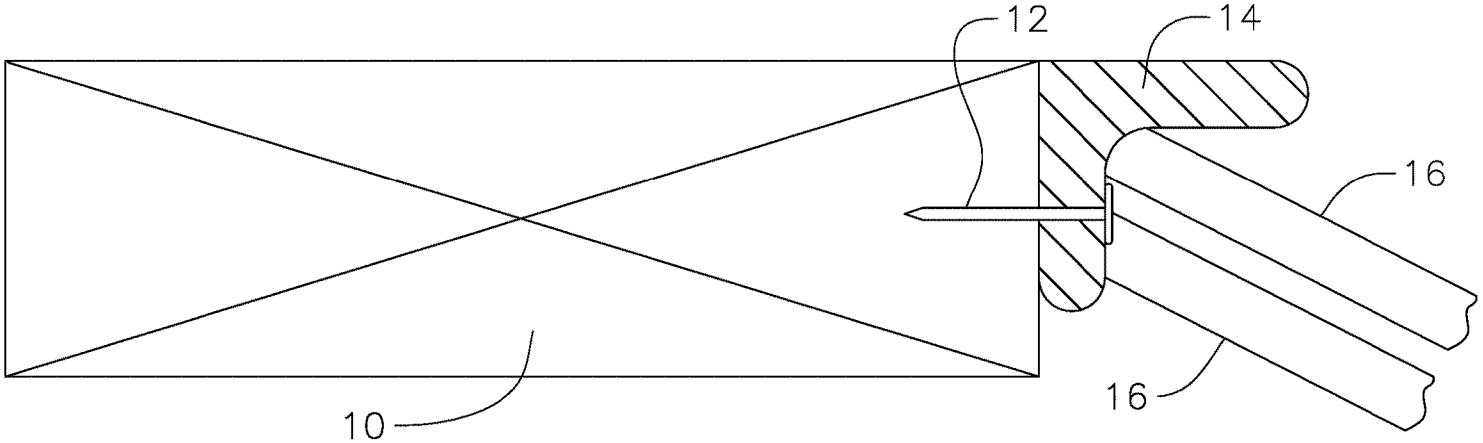
FIG. 2 PRIOR ART
FIG. 2 is a partial cross-sectional view of a prior art form.
Figure 3:
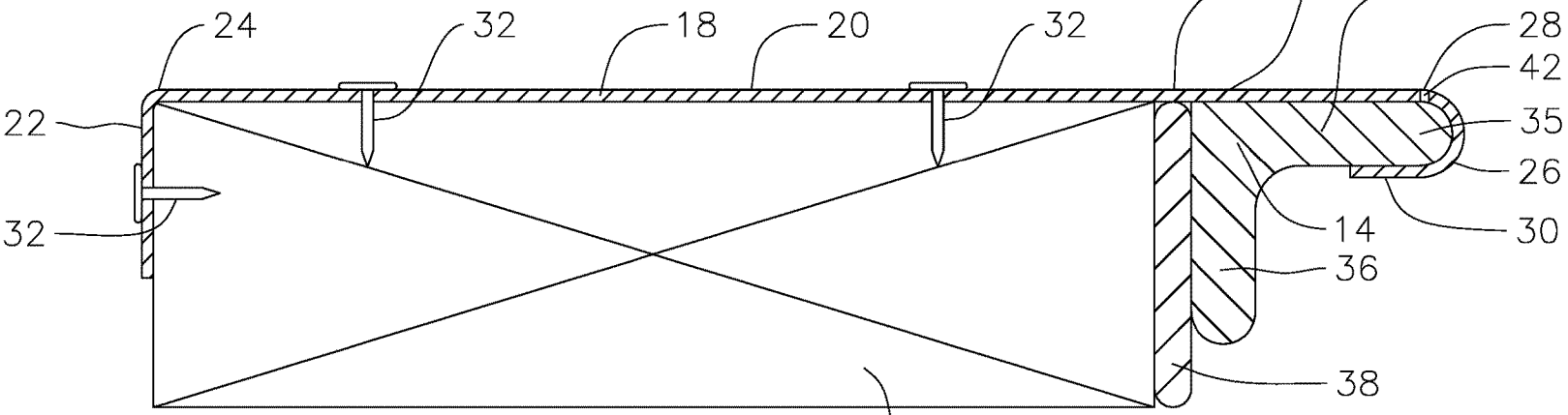
FIG. 3 is a partial cross-sectional view of an example embodiment form.
Figure 4:
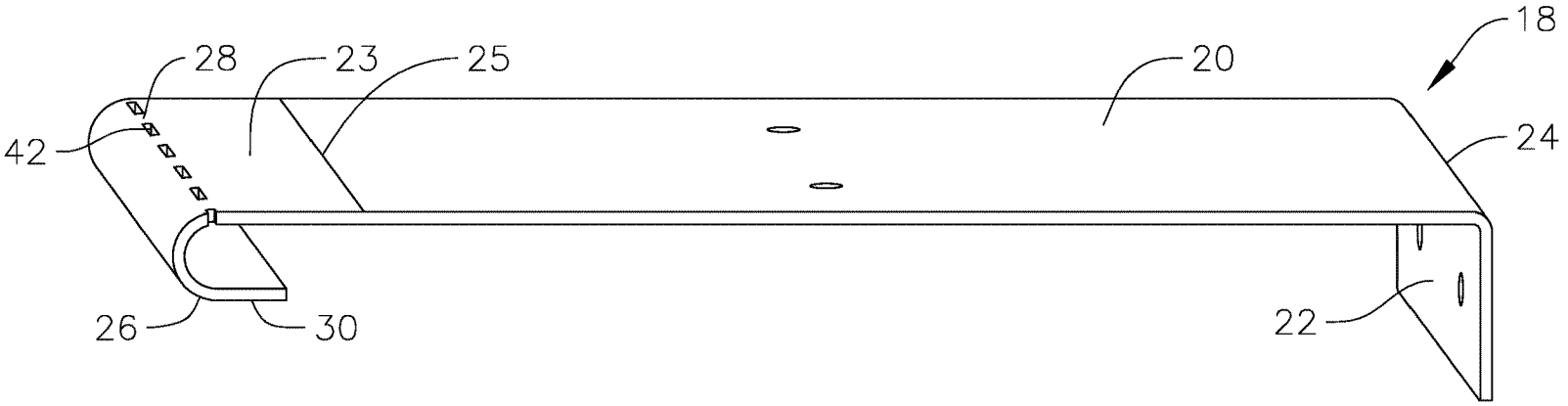
FIG. 4 is a perspective view of an example embodiment clip.
Figure 5:
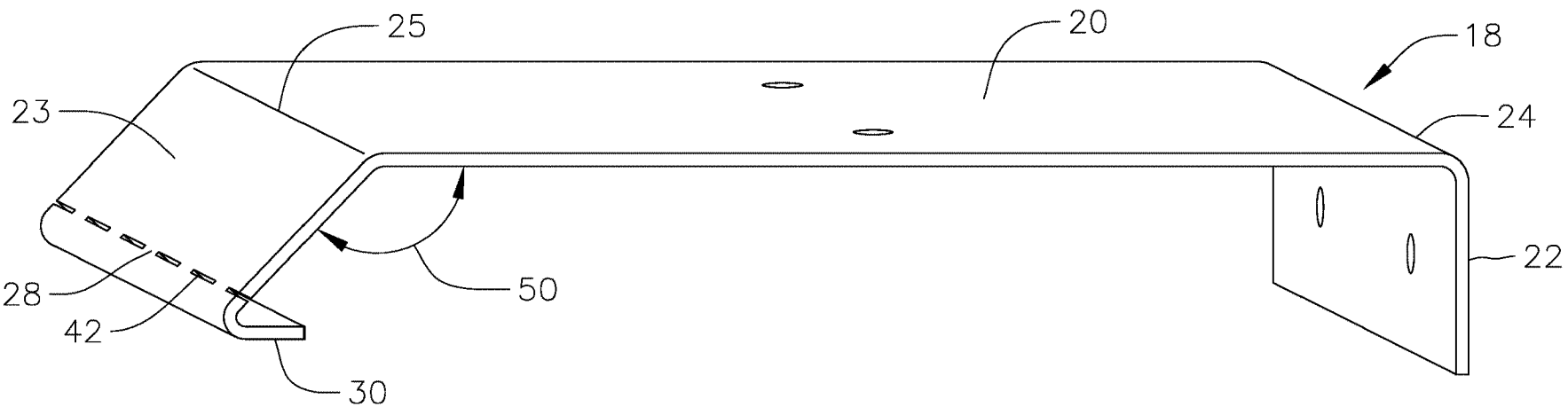
FIG. 5 is a perspective view of another example embodiment clip.

In an example embodiment, a breakaway form clip ("clip") 18 is provided, as for example shown in FIGS. 3, 4 and 5. The clip has a main body portion 20. An arm portion 22 extends transversely from a first end 24 the body portion 20. An extension portion 23 extends from a second end 25 opposite the first end 24. In the example embodiment shown in FIG. 4, the extension portion is a linear extension of the main body portion. In another example embodiment as shown in FIG. 5 the extension portion extends transversely at an angle 50 from the main body portion. A hook portion 26 extends from an end 28 of the extension portion opposite the second end 25 of the main body portion. In the example embodiment clips shown in FIGS. 3, 4, and 5, the hook portion has a return portion 30 extending rearwardly toward the arm portion. In example embodiments, the return portion is parallel, or almost parallel to the body portion 29.

In an example embodiment, the clip 18 is fastened to the wood or steel forming the form with screws or nails 32 through the clip main body portion and through the arm portion 22. The structural member 14 structural member is placed adjacent the form. The structural member has a first section 34 and a second section 36 extending transversely from the first section. In the shown example embodiment, the second section is perpendicular to the first section. The second section 36 is placed adjacent the form 10. In an example embodiment, spacer 38 such as a wood spacer, may be used between the second arm 38 and the form 10. The extension portion extends over the structural member first section 34 and end portion 35 of the first section 34 of the structural member is received in the hook portion 26 of the clip. The hook portion retains the structural member 14 in the appropriate position without the use of fasteners, such as nails or screws, for example.

The clip has a breakaway section 42 at the intersection of the extension portion and the hook portion. The breakaway section is weaker than its adjacent portions. For example, the breakaway section is weaker than the extension portion and the hook portion. In an example embodiment the breakaway portion is also weaker than the main body portion. The breakaway section may be formed by forming perforations or serrations along a line separating the extension portion from the hook portion. In an example embodiment, the breakaway section is formed by a line of spaced apart perforations extending across the width of the clip. In other example embodiments, the breakaway section is formed by reducing the thickness of the clip along a line. In other example embodiments, the clip may include additional breakaway sections.

In example embodiments where the structural member is member such as an angle whose arms are not perpendicular to each other, the extension portion extends transversely from the main body portion at angle 50 so that when placed over the structural member, the clip extension portion will mate or be parallel with a surface portion of the structural member. The angle 50 that the extension portion extends from the main body portion may be any angle to accommodate different structural members.

In an example embodiment only the clip only has the second breakaway section 42 formed between the extension portion and the hook portion.

Once the form is formed and the concrete is poured and cured, the clip main body portion 20 including the arm 22 may be removed by tearing away along the first breakaway section 42. The tearing can occur by striking the main body portion with the hammer or mallet. In other example embodiments, instead of concrete, another type of curing material may be poured in the form and cured.

In an example embodiment the clip is made from a metal material. In another example embodiment, the clip is made of a plastic material. While the description herein has been made in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. Although relative terms such as "outer," "inner," "upper," "lower," "below," "above," "vertical," "horizontal," and similar terms may have been used herein to describe a spatial relationship of one element to another, it is understood that these terms are intended to encompass different orientations of the various elements and components of the invention in addition to the orientation depicted in the figures. Additionally, as used herein, the term "substantially" and similar terms are used as terms of approximation and not as terms of degree, and are intended to account for the inherent deviations in measured or calculated values that would be recognized by those of ordinary skill in the art. Moreover, the tasks described above may be performed in the order described or in any other suitable sequence. Additionally, the methods described above are not limited to the tasks described. Instead, for each embodiment, one or more of the tasks described above may be absent and/or additional tasks may be performed. Furthermore, as used herein, when a component is referred to as being "on" another component, it can be directly on the other component or components may also be present there between. Moreover, when a component is referred to as being "coupled" to another component, it can be directly attached to the other component or intervening components may be present there between.

The invention claimed is:

1. A clip holding a structural member in position relative to a form member of a form for receiving a material to be cured, the structural member having a first portion coupled to the form member and a second portion extending transversely from the first portion, the clip comprising:

a main body portion configured to be positioned over the form member;

a U-shaped hook portion defining a channel extending from the main body portion, the channel receiving the second portion of the structural member and at least partly holding the structural member in said position;

a weakened breakaway section located between the main body portion and the hook portion, the weakened breakaway section configured to separate the hook portion from the main body portion;

wherein the clip is a unitary structure of one-piece construction composed of a single piece of a material.

2. The clip as recited in claim 1, wherein the main body portion is planar.

3. The clip as recited in claim 1, wherein the clip further comprises an arm extending transversely from the main body portion from an end of the main body portion opposite the hook portion.

4. The clip as recited in claim 1, wherein the material is be cured is concrete.

5. The clip as recited in claim 1, wherein the material is one of metal or plastic.

6. The clip as recited in claim 1, wherein the clip further comprises an extension portion extending from the main body portion, wherein the hook portion extends from the extension portion.

7. The clip as recited in claim 6, wherein the extension portion extends transversely from the main body portion.

8. The clip as recited in claim 6, wherein the weakened breakaway section in between the extension portion and the hook portion.

9. The clip as recited in claim 8, wherein the weakened breakaway section is defined by a line of perforations, serrations, or lesser thickness than portions of the clip adjacent said weakened breakaway section extending along a width of the clip.

10. A form for receiving a material to be cured comprising:

a form member forming the form;

a structural member having a first section coupled to the form member and a second section extending transversely from the first section;

a clip comprising a main body portion positioned over the form member and a U-shaped hook portion defining a channel extending beyond the form member, wherein the second section of the structural member is received in the channel defined by the hook portion and is at least partly held in position by said hook portion, and wherein the clip comprises a weakened breakaway section located between the main body portion and the hook portion, the weakened breakaway section configured to separate the hook portion from the main body portion, wherein the clip is a unitary structure of one-piece construction composed of a single piece of a material.

11. The form as recited in claim 10, wherein the main body portion is planar.

12. The form as recited in claim 10, wherein the main body portion is fastened to the form member.

13. The form as recited in claim 10, further comprising a spacer positioned between the first section of the structural member first section and the form member.

14. The form as recited in claim 10, wherein the material to be cured is concrete.

15. The form as recited in claim 10, wherein the material is one of metal or plastic.

16. The form as recited in claim 10, wherein the clip further comprises an arm extending transversely from the main body portion from an end of the main body portion opposite the hook portion, wherein the main body portion extends over a surface of the form member and the arm extends over another surface of the form member.

17. The form as recited in claim 16, wherein the arm is fastened to the form member.

18. The form as recited in claim 10, wherein the clip further comprises an extension portion extending from the main body portion and over the second section of the structural member, wherein the hook portion extends from the extension portion.

19. The form as recited in claim 18, wherein the extension portion extends transversely from the main body portion.

20. The form as recited in claim 18, wherein the clip weakened breakaway section in between the extension portion and the hook portion.

21. The form as recited in claim 20, wherein each the weakened breakaway section is defined by a line of perforations, serrations, or lesser thickness than portions of the clip adjacent said weakened breakaway section extending along a width of the clip.

* * * * *